United States Patent [19]

Liotta et al.

[11] 4,363,714

[45] Dec. 14, 1982

[54] O-ALKYLATED/O-ACYLATED COAL LIQUIDS

[75] Inventors: Ronald Liotta, Clark; Martin L. Gorbaty, Westfield, both of N.J.

[73] Assignee: Exxon Research and Engineering Co., Florham Park, N.J.

[21] Appl. No.: 216,627

[22] Filed: Dec. 15, 1980

Related U.S. Application Data

[63] Continuation-in-part of Ser. No. 69,066, Aug. 23, 1979, Pat. No. 4,259,173, which is a continuation-in-part of Ser. No. 969,361, Dec. 14, 1978, abandoned.

[51] Int. Cl.[3] ..... C10G 1/00; C10C 00/00; C10G 00/00; C10G 1/06

[52] U.S. Cl. ..... 208/14; 208/22; 208/46; 208/9; 208/10; 208/8 LE

[58] Field of Search ..... 208/8 LE, 9, 46, 14, 208/22, 10

[56] References Cited

U.S. PATENT DOCUMENTS

| | | | |
|---|---|---|---|
| 2,378,762 | 6/1945 | Frey | 208/46 |
| 3,359,197 | 12/1967 | Masciantanio et al. | 208/14 |
| 3,376,212 | 4/1968 | Masciantanio et al. | 208/14 X |
| 3,617,513 | 11/1971 | Wilson et al. | 208/8 LE X |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 48/202 X |
| 4,089,772 | 5/1978 | Gorbaty et al. | 208/8LE |
| 4,092,235 | 5/1978 | Schlosberg et al. | 208/8 LE |

FOREIGN PATENT DOCUMENTS

| | | |
|---|---|---|
| 851191 | 5/1977 | Belgium . |
| 2634419 | 10/1977 | Fed. Rep. of Germany . |

OTHER PUBLICATIONS

Brändström et al. Acta Chem. Scand. 23(1969) No. 6.

Wagenknecht et al. Synethetic Communications 2(4), 215–219, (1972).

A. McKillop et al. Tetrahedron vol. 30, pp. 1379–1382 (1974).

Bashall et al. Tetrahedron Letters No. 40 pp. 3489–3490, (1975).

Dehmlow et al. Tetrahedron Letters No. 2, pp. 95–96 (1976).

Blom et al.Fuel 36 135 (1957).

Yohe et al. J.A.C.S. vol. 69 pp. 2644–2648.

Sternberg et al. Fuel 53 172∝175 (1974).

Heathcoal et al. JCS 1932 pp. 2839–2843.

Kröger et al. Erdölund Kohler Erdgor Petrachemic 18JAHRG–Mai1965 NR5.

Soklova Chem. Ab. vol. 48 p.3672i (1954).

Figassi Coal 1962 p. 4946.

Hodek et al. Fuel 1973 vol. 52, Jul. pp. 220–225.

Hodek et al. ACS Div. of Pet. Chem. 22(2), 462 (1977).

Olleman Analytical Chem. vol. 24, No. 9, Sep. 1952.

Nazumdor et al. Fuel 36, 254–256 (1957).

Nandi et al. J. of Iah. Chem. Sor. Ind. & New Ed. vol. 20 No. 2 1957.

Nandi et al. Jour. of Indian Chem. Soc. Ind. & News Ed. vol. 20 #3 & 4, 1957.

Roy et al. J. Sci Industri Res. vol. 18B, Nov. 1959, pp. 492–493.

Baveyie et al. J. Sci Ind. Research 19B(1960).

Senet al. J. Sci. & Ind. Research India 19B(1960).

*Primary Examiner*—Delbert E. Gantz
*Assistant Examiner*—William G. Wright
*Attorney, Agent, or Firm*—Henry E. Naylor

[57] ABSTRACT

Coal liquids are disclosed wherein the hydrogen of substantially all of the hydroxyl groups of the coal liquids have been replaced with $C_1$ to $C_{20}$ alkyl or acyl groups.

4 Claims, No Drawings

O-ALKYLATED/O-ACYLATED COAL LIQUIDS

CROSS-REFERENCE TO RELATED APPLICATIONS

This is a continuation-in-part application of Ser. No. 69,066, filed Aug. 23, 1979 now U.S. Pat. No. 4,259,173 which is a continuation-in-part application of Ser. No. 969,361, filed Dec. 14, 1978, now abandoned.

BACKGROUND OF THE INVENTION

The present invention relates to oxygen-alkylated and/or oxygen-acylated coal liquids, which are more soluble in common organic solvents and more compatible with petroleum liquids than such coal liquids not alkylated.

A major use of coal liquids, particularly high boiling coal liquids, could be in a fuel blend consisting of both coal and petroleum liquids. Unfortunately, coal liquids, such as those derived by hydrogenation processes, do not appear to be compatible with petroleum liquids in that addition of small amounts of the former to the latter causes precipitation.

Without subscribing to any particular theory, one likely reason for this is that coal liquids are more polar than petroleum liquids, due to the presence of phenolic and carboxylic functionalities. These polar functionalities cause intermolecular association between adjacent coal liquid molecules and tend to hold the coal liquid molecules together by a network of hydrogen bonds. Petroleum liquids, which lack these polar functional groups, cannot participate in the intermolecular association. As a result, segregation occurs, and the petroleum and coal liquids separate into distinct layers.

SUMMARY OF THE INVENTION

In accordance with the invention, functionalities having weakly acidic protons in coal liquids are treated by a process selected from the group consisting of alkylation and acylation (sometimes referred to herein as oxygen or O-alkylation and oxygen or O-acylation). Weakly acidic protons include phenolic, carboxylic and mercaptan functionalities. The O-alkylation or O-acylation is conveniently carried out by use of a phase transfer agent and an alkylating or acylating agent. The phase transfer reagent, which is recyclable, is, by way of example, a quaternary ammonium or phosphonium base ($R_4QOR''$), where each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl. The alkylating and acylating agents are represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

The O-alkylated or O-acylated coal liquids are compatible with petroleum liquids and thus can more easily mix with petroleum liquid molecules.

DETAILED DESCRIPTION OF THE INVENTION

Coal liquids are those liquids derived from coal by a variety of processes, including hydrogenation, donor solvent reactions, pyrolysis in the presence and absence of hydrogen and extraction in various solvents. Exemplary of the solvent hydrogen donor liquefaction process is that described in U.S. Pat. No. 3,617,513. The process disclosed herein may be advantageously employed with any coal liquid, regardless of derivation.

By the process of the invention, functionalities containing weakly acidic protons in the coal liquid are chemically altered. For example, acidic proton-containing groups such as phenolic and carboxylic, which are very polar functional groups are converted to relatively non-polar ethers and esters respectively. The chemical transformation may be represented as follows:

$$Ar{-}OH + R'X \rightarrow Ar{-}OR'$$

$$Ar{-}COOH + R'X \rightarrow Ar{-}COOR'$$

where R' is a $C_1$ to about $C_{20}$ alkyl or acyl group, preferably a $C_1$ to $C_4$ group.

The O-alkylation or O-acylation of coal liquids by reagents which are in liquid solution is greatly influenced by the use of a phase transfer reagent. Such a reagent has both a lipophilic and a hydrophilic portion and is capable of transferring a basic species, —OR'', from an aqueous phase to either a solid or liquid organic phase, where R'' is either hydrogen or a carbon-bearing functionality. The phase transfer reagent may be generated catalytically, in which case the process is termed a phase transfer catalysis, which is a well-known reaction; see, e.g., Vol. 99, Journal of the American Chemical Society, pp. 3903–3909 (1977). Alternatively, the reagent may be generated in a separate step, then used in the alkylation or acylation reaction. If this latter reaction is employed, then the active form of the reagent may be regenerated in a subsequent step. In yet another embodiment, a blend consisting of coal and petroleum liquids and the alkylating or acylating agent may be contacted either by caustic and quaternary salt (catalyzed reaction) or by quaternary base (non-catalyzed reaction), and the compatible product removed. In any event, the overall chemical transformation on the coal-derived liquid is the same. A generalized mechanistic scheme for this transformation is shown below:

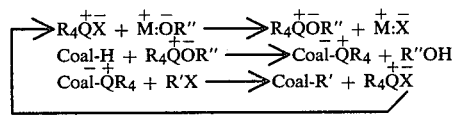

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_6$ to about $C_{20}$, preferably $C_6$ to $C_{12}$ aryl group; Q is nitrogen or phosphorus, preferably nitrogen, and R'' is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably hydrogen. The phase transfer reagent may be generated by reacting the corresponding quaternary salt $R_4QX$ with a metal base MOR'' where X is selected from the group consisting of halide, sulfate, bisulfate, acetate and stearate. Preferred is when X is a halide selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is previously defined, as long as X is attached to a primary or secondary carbon atom. Preferably R' is an inert hydrocarbon, that is, a hydrocarbon group containing only hydrogen and carbon although hydrocarbon groups containing other functionality may also be suitably for use herein, even though less desirable. It will be noted that the acidic proton H (hydrogen atom) is usually located on phenolic groups in higher rank coals and on carboxylic groups for lower rank coals. The acidic proton may also be located to a lesser extent on sulfur, nitrogen, etc.

Phase transfer reagents such as quaternary ammonium hydroxide ($R_4QOR''$) are very effective in the O-alkylation and O-acylation of coal liquids. These O-alkylation and O-acylation reactions are successful because the —OR'' portion of the molecule is soluble in an organic medium. When this base is present in such a medium, it is not solvated by water or other very polar molecules. An an unsolvated entity, it can react as a very efficient proton transfer reagent. For example, $$(\text{Coal})\text{—OH} + \text{O}^-\text{R} \rightarrow (\text{Coal})\text{—O}^- + \text{R''OH}$$

This unsolvated base (also known as a "naked hydroxide" when R'' is hydrogen) can have a wide variety of counter ions. Although the counter ion may be a quaternary ammonium or phosphonium species as previously discussed, other examples of counter ions useful in the practice of the invention include "crown ether" complexes of a salt containing the OR'' anion and clathrate compounds complexed with a salt containing the OR'' anion. Salts represented by MOR'', where M is as given above, when complexed with crown ethers, for example, have been previously demonstrated to evidence a reactivity similar to that found for $R_4QOR''$ compounds.

In one embodiment of the process of the invention a two-phase liquid/liquid system is employed, comprising the coal liquid and aqueous phase. Alternatively, as mentioned above, a three-phase system comprising the coal liquid and aqueous phase, together with a petroleum liquid, may be employed.

Although not necessary, a solvent may be added if desired. The solvent may be used to dissolve alkylated or acylated carbonaceous product or to dissolve alkylating or acylating agent (especially if the agent is a solid and is comparatively insoluble in water). The solvent may also be used to provide for more efficient mixing. Many of the common organic solvents may be employed in any reasonable amount, depending on the desired result.

The phase transfer reagent that is used must dissolve in or be suspended in both phases so that it has intimate contact with both the organic and aqueous phases. During the course of the reaction, the phase transfer reagent will partition itself into both of these phases. Quaternary bases are one class of compounds useful as phase transfer reagents in the practice of the invention and are given by the formula $R_4QOR''$, where R is an alkyl group having at least one carbon atom, and preferably 1 to 20 carbon atoms, and more preferably 1 to 6 carbon atoms or an aryl group having 6 to 20 carbon atoms, preferably 6 to 12 carbon atoms. The lower number of carbon atoms is preferred, since such compounds are more water soluble and can be removed from the alkylated or acylated coal liquid by simple water washing. The R groups may be the same or different. Examples of R groups include methyl, butyl, phenyl and hexadecyl.

Examples of quaternary bases useful in the practice of the invention include the following:

1. Tetrabutylammonium hydroxide $(C_4H_9)_4NOH$
2. Benzylhexadecyldimethylammonium hydroxide, $(C_6H_5CH_2)(C_{16}H_{33})(CH_3)_2NOH$
3. Tetrabutylphosphonium hydroxide, $(C_4H_9)_4POH$
4. ADOGEN 464, $(C_8\text{–}C_{10})_4NOH$ (ADOGEN 464 is a trademark of Aldrich Chemical Company, Metuchen, N.J.).

The metal base used to convert the quaternary salt to the corresponding base is an alkali metal or alkaline earth metal base such as NaOH, KOH, $Ca(OH)_2$ or $NaOCH_3$. The use of an alkoxide, for example, permits use of the corresponding alcohol in place of water, which may provide an advantage in process flexibility.

In chosing the alkylating and/or acylating reagent, two considerations must be weighed. First, it is desired to add longer chains to the coal liquid which render the product more petroleum-like, and, therefore, more soluble in organic solvents and more compatible with petroleum liquids. On the other hand, shorter chains render the alkylated or acylated coal liquid product more volatile. Second, shorter chain materials are also less expensive and still improve solubility.

In the case of O-alkylation, the carbon to which the leaving group is attached may be either a primary or secondary carbon atoms. Primary carbon halides have been found to react faster than the corresponding secondary halides in a phase transfer or phase transfer catalyzed reaction on carbonaceous materials and are accordingly preferred. While the balance of the carbon-bearing functional group may, in general, contain other moieties, siuch as heteroatoms, aryl groups and the like, bonding of the carbon-bearing functional group to the phenolic or carboxylic oxygen is through either an $sp^3$ hybridized carbon atom (alkylation) or an $sp^2$ hydridized carbon atom (acylation). Further, a mixture of alkylating or acylating agents or a mixture of both may advantageously be employed. Such mixtures are likely to be generated in coal-treating plants in other processing steps and thus provide a ready source of alkylating and/or acylating agents. Examples of alkylating and acylating agents useful in the practice of the invention include ethyl iodide, isopropyl chloride, dimethyl sulfate, benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well-known process. When a system containing more than one alkylating or acylating agent is used, the hydrocarbon precursor is preferably a product stream of a certain cut derived from coal and petroleum processing and the like. This stream may contain minor amounts of components having various degrees of unsaturation which are also suitable for reacting with the phenolic and carboxylic groups herein, as long as X (as previously defined) is attached to an alkyl or saturated carbon atom in the resulting alkylating or acylating reagent. Second, acylating reagents are susceptible to hydrolysis. Since water is present due to the nature of the inventive process, some loss of acylating agent may occur by hydrolysis. In contrast, alkylating reagents do not evidence the same susceptibility to hydrolysis.

If the O-alkylation or O-acylation is carried out by a catalytic process, then the quaternary salt, metal base and alkylating or acylating agent are mixed directly with the coal liquid. The quaternary salt catalyst may be present in small amounts, typically about 0.05 to 10 wt. % of the amount of coal liquid used; however, greater amounts may also be employed. The metal base and the alkylating or acylating agent must be present in at least stoichiometric quantities relative to the number of acidic sites (phenolic, carboxylic, etc.) in the coal liquids, but preferably an excess of each is used to drive the reaction to completion. Advantageously, a two-fold excess of metal base and alkylating or acylating agent is employed; however, a greater excess may be employed. After the reaction, the excess quaternary base and quaternary salt catalyst may be removed from the coal liquid by ample water washing for recycling. Excess metal base will also be extracted into the water wash, and it may be reused. Excess alkylating or acylating agent may be conveniently removed from the treated coal liquid by fractional distillation or by solvent extraction with pentane or other soluble solvent and may be reused.

To cap off all acidic protons in a typical coal liquid employed in the catalytic process, less than about 2 days are required for 100% conversion, employing only a slight excess of alkylating or acylating agent under atmospheric pressure and ambient temperature. A greater excess of alkylating or acylating agent will reduce the reaction time considerably.

A faster alkylation or acylation reaction may be tained in a number of ways, one of which is to add the phase transfer reagent ($R_4QOR''$) directly to the coal liquid rather than to form this reagent in situ with the reaction in which the coal liquid is alkylated or acylated. When this is done, substantially complete conversion of all the phenolic and carboxylic groups is achieved in a matter of minutes. The amount of quaternary base added ranges from about stoichiometric proportions to about 10 times the total number of acidic sites in the coal liquid which are capable of undergoing alkylation or acylation. As before, the quaternary salt that is generated in the alkylation or acylation step may be recovered and recycled by reacting it with fresh metal base to regenerate the quaternary base. By employing this two-step process, there is no contact between metal base and the coal liquid, and the reaction is essentially complete in about one hour.

In another embodiment, a blend of coal liquids and petroleum liquids and the alkylating or acylating agent is contacted with an aqueous solution containing the phase transfer reagent. The alkylation or acylation may be performed catalytically or non-catalytically, employing the procedures outlined above.

The temperature at which the reaction is carried out may range from ambient to the boiling point of the materials used. Increased temperature will, of course, speed up the reaction rate.

The reaction may be stirred or agitated or mixed in some fashion to increase the interface or surface area between the phases, since there can be aqueous and organic phases present.

The reaction is carried out at ambient pressure, although low to moderate pressures (about 2 to 20 atmospheres) may be employed along with heating to increase the reaction rate.

Once the reagents and solvents if any are removed from the alkylated or acylated coal liquid, infrared analysis may be conveniently used to demonstrate that all the hydroxyl groups have been alkylated or acylated. If the added alkyl or acyl groups is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or acyl substituent. For example, the increase in the H/C ratio of O-methylated coal liquid derived from Illinois No. 6 coal indicates that 3.5 methyl groups per 100 carbon atoms are added to the coal liquid. The H/C ratio in the untreated coal liquid derived from Illinois No. 6 coal is 1.004 and H.C ratio after O-methylation by the process of the invention is 1.037. The treated coal liquids become more soluble in common organic solvents. For example, the solubility (20° C.) of O-methylated coal liquids in cyclohexane increases to 63% from 11% for untreated coal liquids.

The alkylated and acylated coal liquids formed by the process of the invention are more compatible with petroleum liquids, as indicated by the increased solubility of alkylated and acylated coal liquids in petroleum liquids. Blends of coal liquids treated in accordance with the invention and petroleum liquids evidence increased stability. EXAMPLES

EXAMPLE 1

Phase Transfer Catalyzed Alkylation

A coal liquid derived from Illinois No. 6 coal by Exxon's donor solvent process was treated as follows:

In a 250 ml round bottom flask which was flushed with nitrogen and equipped with a mechanical stirrer were added the following components: 5.0 g of coal liquids (650°–1050° F., derived from Illinois No. 6 by hydrogen donor solvent liquefaction), 0.25 g of tetrabutylammonium iodide (as received from Aldrich Chemical), 50 ml of toluene (spectrograde from Matheson, Coleman and Bell, purged with nitrogen), 35 ml of 20% aqueous solution of NaOH (purged with nitrogen) and 11.0 g of iodomethane (added dropwise with vigrous stirring). A nitrogen atmosphere was maintained for 5 days, until the reaction was assumed to be complete. The layers were separated in a separatory funnel. The organic layer was washed eleven times with 150 cc portions of water to remove caustic and catalyst. The toluene and residual iodomethane were stripped off under vacuum at 100° C.

The solubility (20° C.) of coal liquid vacuum gas oil increased from 11% to 63% in cyclohexane after phase transfer catalyzed O-methylation in cyclohexane solvent.

A one to two order of magnitude increase in solubility of the O-methylated (versus untreated) coal liquid vacuum gas oil in a petroleum liquid, which was a desulfurized Aruba high viscosity fuel oil, was observed.

EXAMPLES 2–5

Phase Transfer Catalyzed Alkylation

The following reactions were carried out on various coal liquids employing the reagents in the amounts indicated shown in the following Table.

TABLE

PHASE TRANSFER CATALYZED REACTIONS

| Example | Coal Liquid | Solvent | Catalyst(1) | Caustic(2) | R'X(3) |
|---|---|---|---|---|---|
| 2 | Vacuum gas oil | Xylenes | B, 10% | NaOH, 12% | $C_4H_9Cl$, 443% |
| 3 | Vacuum gas oil | Toluene | B, 3.3% | NaOH, 12% | $C_2H_5I$, 570% |
| 4 | Vacuum gas oil | Toluene | T, 5% | NaOH, 20% | $CH_3I$, 1100% |
| 5 | Vacuum gas oil | Toluene | T, 5% | NaOH, 12% | $CH_3I$, 200% |

Definition of Symbols
(1)B is benzylhexadecyldimethylammonium chloride and T is tetrabutylammonium chloride; wt. percent is relative to coal liquid.
(2)Weight percent of metal base in water.
(3)Weight percent relative to coal liquid.

COMPARATIVE EXAMPLE 10 g of coal liquid derived from Illinois No. 6 coal, 6 g of sodium hydroxide and 50 g of distilled water were stirred together under nitrogen for 5 minutes. 8 g of dimethylsulfate was then added and the resulting solution was reflexed for 2 hours at approximately 70° C. The temperature was lowered to stop the refluxing and 50 ml of a 1 M sodium hydroxide solution and 8 g of dimethyl sulfate were added. This solution was then refluxed at approximately 70° C. for another 2 hours after which the resulting solution was allowed to remain overnight at room temperature (approx. 25° C.).

The solution (which was comprised of an aqueous phase and an organic layer) was then put in a separatory funnel and 300 ml of distilled water and 10 ml of dimethyl ether were added to ease separation of the aqueous and organic layers. The treated coal liquid was washed with distilled water until a negative test for $Ag_2SO_4$ was obtained. The treated coal liquid was stripped of ether and analyzed by conventional MNR and gas chromatographic techniques. These analysis showed that no methylation of the treated coal liquid has occurred. That is analysis revealed that the treated coal liquid was substantially identical to the untreated coal liquid.

EXAMPLE 6

Phase Transfer Catalyzed Alkylation 0.5 g of coal liquid derived from Illinois No. 6 coal, 5 ml of tetrabutylammonium hydroxide, and 10 ml of tetrahydrofuran was stirred for 30 minutes at room temperature and at approximately 1 atm. pressure. 1.44 g of $^{13}CH_3I$ was added and stirring was continued, at room temperature, for 24 hours. About 20 drops of 3.33 M HCL was added to acidify the solution to a pH of about 1. The tetrahydrofuran and excess $^{13}CH_3I$ was stripped off on a Rotovap at 40° C. 50 ml of distilled water and 50 ml of chloroform as well as the treated coal liquid were introduced into a separatory funnel and the chloroform layer (containing the treated coal liquid) was extracted. The chloroform was then stripped off and the treated coal liquid was analyzed by conventional $^{13}C$—NMR and infrared techniques. NMR revealed that methylation had taken place and that methyl phenyl ethers were produced. Infrared analysis revealed that no —OH groups remained in the treated coal liquid. Consequently, the analysis indicates that the hydroxyl groups of the coal liquid, as treated in accordance with the present invention, was completely methylated resulting in the formation of methyl phenyl ethers.

What is claimed is:

1. A coal liquid in which the hydrogen of substantially all of the hydroxyl groups of the coal liquid have been replaced with $C_1$ to $C_{20}$ alkyl or acyl groups.

2. The coal liquid of claim 1 wherein the hydrogens are replaced with $C_1$ to $C_4$ alkyl or acyl groups.

3. The coal liquid of claim 2 wherein the hydrogens are replaced with $C_1$ to $C_4$ alkyl groups.

4. The coal liquid of claim 3 wherein the alkyl groups are methyl groups.

* * * * *